US011020796B2

(12) United States Patent
Mochizuki et al.

(10) Patent No.: US 11,020,796 B2
(45) Date of Patent: Jun. 1, 2021

(54) IMMERSION-TYPE BURNER HEATER AND MOLTEN-METAL HOLDING FURNACE

(71) Applicant: Tounetsu Co., Ltd., Fujinomiya (JP)

(72) Inventors: Kiyata Mochizuki, Fujinomiya (JP); Manabu Yamada, Osaka (JP)

(73) Assignee: TOUNETSU CO., LTD., Fujinomiya (JP)

( * ) Notice: Subject to any disclaimer, the term of this patent is extended or adjusted under 35 U.S.C. 154(b) by 41 days.

(21) Appl. No.: 16/332,905

(22) PCT Filed: Oct. 23, 2017

(86) PCT No.: PCT/JP2017/038176

§ 371 (c)(1),
(2) Date: Mar. 13, 2019

(87) PCT Pub. No.: WO2018/079482

PCT Pub. Date: May 3, 2018

(65) Prior Publication Data

US 2019/0255605 A1 Aug. 22, 2019

(30) Foreign Application Priority Data

Oct. 28, 2016 (JP) ..... JP2016-211632
Sep. 8, 2017 (JP) ..... JP2017-172597

(51) Int. Cl.
*B22D 18/04* (2006.01)
*B22D 41/015* (2006.01)
(Continued)

(52) U.S. Cl.
CPC ..... *B22D 18/04* (2013.01); *B22D 41/015* (2013.01); *B22D 45/00* (2013.01); *F23D 14/12* (2013.01); *F27B 3/20* (2013.01)

(58) Field of Classification Search
CPC . F23C 3/002; F23C 3/004; F23C 2900/03009
(Continued)

(56) References Cited

U.S. PATENT DOCUMENTS 2,115,769 A * 5/1938 Harris ..... C21D 9/00 126/91 A
3,285,240 A * 11/1966 Schmidt ..... F23D 14/22 126/91 A
(Continued)

FOREIGN PATENT DOCUMENTS

CN 103574632 2/2014
DE 1230163 12/1966
(Continued)

*Primary Examiner* — Vivek K Shirsat
(74) *Attorney, Agent, or Firm* — Fay Kaplun & Marcin, LLP

(57) ABSTRACT

An immersion-type burner heater includes a heater protection tube that is installed so as to penetrate a furnace wall or an upper lid of the molten-metal holding furnace with the tip end thereof being closed; an inner cylindrical member arranged inside the tube so as to define a combustion flow passage S between the tube and itself with the tip end side thereof being open and the inside thereof serving as an exhaust gas flow passage; and a gas burner part supplying fuel gas and air to the combustion flow passage. A helically extending projecting part is provided on at least one of the outer peripheral surface of the member and the inner peripheral surface of the tube at a position that is closer to its tip end side than to the part penetrating the furnace wall or the upper lid.

7 Claims, 6 Drawing Sheets

(51) Int. Cl.
*B22D 45/00* (2006.01)
*F23D 14/12* (2006.01)
*F27B 3/20* (2006.01)

(58) Field of Classification Search
USPC ..... 431/350, 215, 11, 199, 353, 209; 126/91 A
See application file for complete search history.

(56) References Cited

U.S. PATENT DOCUMENTS 4,705,260 A * 11/1987 Geer ..... C22B 19/00 266/242
5,655,599 A 8/1997 Kasprzyk
6,321,743 B1 * 11/2001 Khinkis ..... F23C 3/002 126/91 A
7,762,807 B2 7/2010 Linck et al.

FOREIGN PATENT DOCUMENTS

| | | |
|---|---|---|
| DE | 270 6981 | 8/1978 |
| GB | 669975 | 4/1952 |
| JP | S55162723 | 11/1980 |
| JP | 11992025912 | 3/1992 |
| JP | H04278108 | 10/1992 |
| JP | 06-016259 | 4/1994 |
| JP | 11-317720 | 12/1999 |
| JP | 2001-108207 | 4/2001 |
| JP | 2012122706 | 6/2012 |
| JP | 2014214882 | 11/2014 |

* cited by examiner

IMMERSION-TYPE BURNER HEATER AND MOLTEN-METAL HOLDING FURNACE

PRIORITY CLAIM

This application is a National Stage application, filed under 35 U.S.C. § 371, of PCT Patent Application Serial No. PCT/JP2017/038176 filed on Oct. 23, 2017, entitled "Immersion-Type Burner Heater and Molten-Metal Holding Furnace", which is hereby incorporated by reference in its entirety.

BACKGROUND OF THE INVENTION

Field of the Invention

The present invention relates to an immersion-type burner heater and a molten-metal holding furnace that are used for casting aluminum, aluminum alloy, or the like as well as for melting ingots, for example.

Description of the Related Art

Conventionally, in order to heat and hold molten metal to be casted such as, for example, aluminum, aluminum alloy, or the like in a molten-metal holding furnace, a heater for heating the molten metal that is configured to be inserted through the furnace wall has been used.

Although a molten-metal holding furnace that employs a metal heating element as a heat source for the heater described above for heating the molten metal has been in practical use, a gas burner has been suggested to be used instead of the metal heating element as a heat source.

For example, Patent document 1 discloses a combustion tubular heater for heating molten metal as a burner heater including an inner cylinder that is arranged inside an outer cylinder serving as a heater protection tube, wherein combustion gas is supplied through the space between the inner cylinder and the outer cylinder, and then the exhaust gas is collected from the inner cylinder.

Such a burner heater increases the temperature of the outer cylinder side by passing the combustion gas between the inner cylinder and the outer cylinder so as to efficiently heat the molten metal. Also, the exhaust gas is collected from the tip-end opening of the inner cylinder through the inside thereof into an exhaust gas pipe on the base end side of the inner cylinder.

Generally, in a molten-metal holding furnace that is configured so that a heater is inserted through the furnace wall and then immersed in the furnace, the molten metal in the furnace can be leaked out of the furnace through the gap between a heater protection tube and the furnace wall. For preventing this leakage, the temperature inside the heater protection tube at the part embedded in the furnace wall has to be 600° C. or lower (the melting point of aluminum is 660° C.), for example, that is the temperature at which, if the molten metal enters the gap between the furnace wall and the heater protection tube, the molten metal can be solidified so as to be prevented from leaking out.

However, when a gas burner is used, the exhaust gas having a high temperature can heat the furnace wall, thus causing the molten metal to leak out. Hence, in the configuration of the burner heater and the molten-metal holding furnace disclosed in Patent document 1, the exhaust gas is collected from the inner cylinder and combustion air is passed through its outside, so that the exhaust gas having a high temperature does not pass through immediately inside the furnace wall.

PRIOR ART DOCUMENT

Patent Document

[Patent Document 1] Japanese Unexamined Patent Application Publication H11-347720

SUMMARY OF THE INVENTION

In the burner heater disclosed in Patent Document 1, the temperature of the furnace wall side is prevented from becoming high by collecting the exhaust gas from the inner cylinder. However, in order to sufficiently lower the temperature of the furnace wall side so as to completely prevent the molten metal from leaking out, the temperature of the exhaust gas has to be further lowered. It also has a problem that since the heat of a flame cannot be efficiently transferred to the heater protection tube, the temperature of the burner heater cannot be efficiently increased and accordingly the combustion gas is inconveniently collected into the inner cylinder and exhausted therefrom before all the gas has been burnt out.

The present invention relates to an immersion-type burner heater and a molten-metal holding furnace that can provide a high heat transfer coefficient and can allow the exhaust gas temperature to be lowered.

Specifically, an immersion-type burner heater according to a first aspect of the present invention comprises: a heater protection tube that is installed so as to penetrate a furnace wall or an upper lid of a molten-metal holding furnace with the tip end thereof being closed; an inner cylindrical member that is arranged inside the heater protection tube so as to define a flow passage for combustion (hereafter referred to as "combustion flow passage") between the heater protection tube and itself with the tip end side thereof being open and the inside thereof serving as an exhaust gas flow passage; and a gas burner part for supplying fuel gas and air to the combustion flow passage, wherein a helically extending projecting part is provided on at least one of the outer peripheral surface of the inner cylindrical member and the inner peripheral surface of the heater protection tube at a position that is closer to its tip end side than to the part penetrating the furnace wall or the upper lid.

In this immersion-type burner heater, since the helically extending projecting part is provided on at least one of the outer peripheral surface of the inner cylindrical member and the inner peripheral surface of the heater protection tube at a position that is closer to its tip end side than to the part penetrating the furnace wall or the upper lid, combustion gas helically advances in the combustion flow passage between the inner cylindrical member and the heater protection tube by being guided by the projecting part. Due to this configuration, the flow rate of the combustion gas can be increased compared with the case without the helically extending projecting part, and therefore the heat transfer coefficient to the heater protection tube by the convection flow can be increased. In addition, the helical advancement of the combustion gas causes a turbulent flow to occur, thereby making it easier to mix the combustion gas with air. As a result, the combustion efficiency can be improved and the amount of the combustion gas that is exhausted from the inner cylindrical member without having been burnt out can be reduced. Furthermore, the increase of the heat transfer coefficient to the heater protection tube can cause the heat exchange to be more actively performed between the molten metal and the heater, thereby making it possible to lower the temperature of the exhaust gas.

An immersion-type burner heater according to a second aspect of the present invention is characterized by the immersion-type burner heater according to the first aspect, wherein the projecting part is provided between the portions of the helical groove that is formed on the inner peripheral surface of the heater protection tube.

Specifically, in this immersion-type burner heater, since the projecting part is provided between the portions of the helical groove that is formed on the inner peripheral surface of the heater protection tube, the projecting part can be readily formed by groove machining or the like on the inner peripheral surface of the heater protection tube and the flow rate or the like of the combustion gas can also be readily set depending on the groove width or the like. In addition, the projecting part can increase the surface area of the heater protection tube, thereby further improving the heat exchanging property between the protection tube and the heater.

An immersion-type burner heater according to a third aspect of the present invention is characterized by the immersion-type burner heater according to the first aspect, wherein the projecting part is a helical fin that is provided on the outer peripheral surface of the inner cylindrical member.

Specifically, in this immersion-type burner heater, since the projecting part is a helical fin that is provided on the outer peripheral surface of the inner cylindrical member, the flow rate or the like of the combustion gas can be readily set depending on the shape of the helical fin or the like.

An immersion-type burner heater according to a fourth aspect of the present invention is characterized by the immersion-type burner heater according to any one of the first to third aspects comprising an air flow passage for supplying air into the combustion flow passage at the part penetrating the furnace wall or the upper lid, wherein a heat exchange fin that is fixed on the inner cylindrical member or an air supply line is provided in the air flow passage.

Specifically, in this immersion-type burner heater, since the heat exchange fin is provided in the air flow passage, the heat exchange is performed between the air that is supplied into the air flow passage and the heat exchange fin that is fixed on the inner cylindrical member or the air supply line, and therefore the supplied air can be efficiently warmed.

An immersion-type burner heater according to a fifth aspect of the present invention is characterized by the immersion-type burner heater according to any one of the first to fourth aspects, wherein a heat insulating member made of a heat insulating material having a lower heat conductivity than that of the heater protection tube is provided on the outer peripheral part of the base end side of the inner cylindrical member.

In the technology disclosed in Patent document 1, since the base end of the inner cylindrical member is overheated and then the exhaust gas is warmed by the base end of the inner cylindrical member, the temperature of the exhaust gas is inconveniently increased. Specifically, the temperature of the base end of the heater becomes very high because this part is in direct contact with the flame of the burner. Therefore, when the inner cylindrical member becomes excessively hot, the temperature of the exhaust gas passing therethrough can also become high.

However, in the present invention, since the heat insulating member made of a heat insulating material having a lower heat conductivity than that of the heater protection tube is provided on the outer peripheral part of the base end side of the inner cylindrical member, the inner cylindrical member can be prevented from being overheated and also heat can be efficiently transferred to the heater protection tube.

In addition, since the tip end of the inner cylindrical member is not in direct contact with the flame of the burner, the temperature thereof becomes lower than that of the base end thereof. Therefore, the inner cylindrical member can be prevented from being overheated by dissipating heat from the inner cylindrical member without attaching the heat insulating material.

A molten-metal holding furnace according to a sixth aspect of the present invention is characterized by the immersion-type burner heater according to any one of the first to fourth aspects, wherein a heat insulating member made of a heat insulating material having a lower heat conductivity than that of the heater protection tube is provided on the inner cylindrical member over a range from its base end side to a vicinity of its tip end.

Specifically, in this molten-metal holding furnace, since the heat insulating member made of a heat insulating material having a lower heat conductivity than that of the heater protection tube is provided on the inner cylindrical member over a range from its base end side to a vicinity of its tip end, the thermal energy generated from the combustion gas can be repelled by the heat insulating member that is provided over a broad range of the outer peripheral part of the inner cylindrical member and heads toward the heater protection tube. As a result, the heat transfer coefficient to the heater protection tube can be increased in proportion to the attached range of the heat insulating member.

A molten-metal holding furnace according to a seventh aspect of the present invention comprises a holding tank for holding molten metal and the immersion-type burner heater according to any one of the first to sixth aspects that is installed so as to penetrate the furnace wall or the upper lid of the holding tank.

Specifically, since this molten-metal holding furnace comprises the immersion-type burner heater according to any one of the first to sixth aspects, the immersion-type burner heater of the present invention having the increased heat transfer coefficient and energy efficiency allows for holding molten metal with less energy compared with that of the prior art.

Effects of the Invention

According to the present invention, the following effects may be provided.

Specifically, in the immersion-type burner heater of the present invention, since the helically extending projecting part is provided on at least one of the outer peripheral surface of the inner cylindrical member and the inner peripheral surface of the heater protection tube at a position that is closer to its tip end side than to the part penetrating the furnace wall or the upper lid, the heat transfer coefficient can be increased and the temperature of the exhaust gas can also be lowered. Accordingly, the combustion efficiency can be improved and the amount of unburnt combustion gas that is exhausted from the inner cylindrical member can be reduced.

Therefore, the immersion-type burner heater and the molten-metal holding furnace of the present invention can allow the temperature of the furnace wall to be lowered compared with that of the prior art, thereby surely preventing the molten metal from leaking out.

DESCRIPTION OF THE EMBODIMENTS

Hereinafter, an immersion-type burner heater and a molten-metal holding furnace according to a first embodiment of the present invention will be described with reference to FIGS. 1 to 3.

Figure 1:
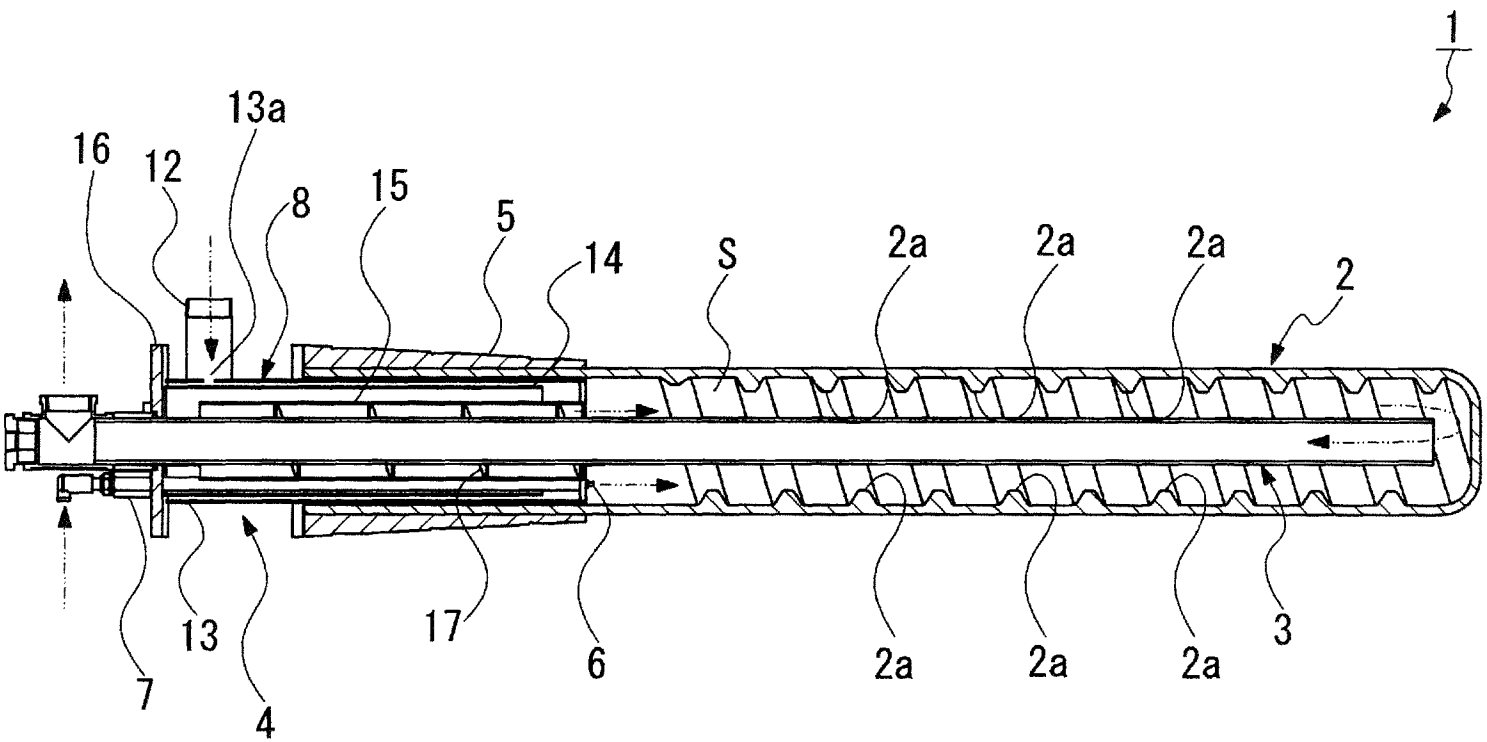
FIG. 1 is a cross-sectional view showing an immersion-type burner heater in an immersion-type burner heater and a molten-metal holding furnace according to a first embodiment of the present invention.
Figure 2:
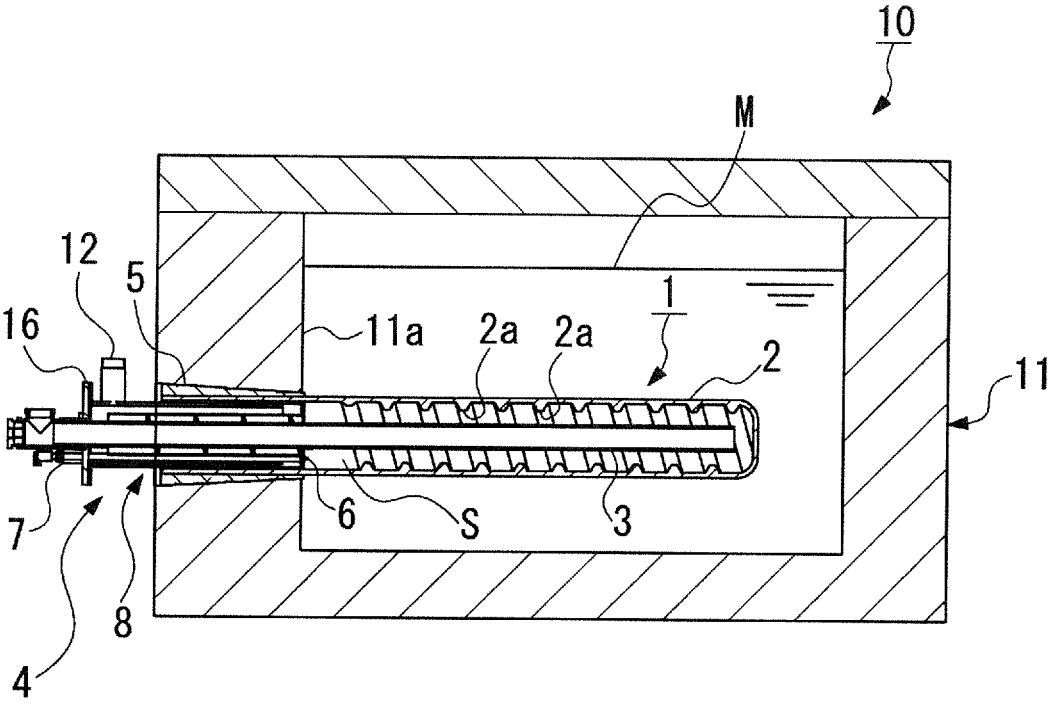
FIG. 2 is a schematic cross-sectional view showing a molten-metal holding furnace in the first embodiment.

As shown in FIGS. 1 and 2, an immersion-type burner heater 1 according to the present embodiment includes a heater protection tube 2 that is installed so as to penetrate a furnace wall 11*a* of a molten-metal holding furnace 10 with the tip end thereof being closed; an inner cylindrical member 3 that is arranged inside the heater protection tube 2 so as to define a combustion flow passage S between the heater protection tube 2 and itself with the tip end side thereof being open and the inside thereof serving as an exhaust gas flow passage; and a gas burner part 4 for supplying fuel gas and air to the combustion flow passage S.

In addition, as shown in FIG. 2, the molten-metal holding furnace 10 of the present embodiment includes a holding tank 11 for holding molten metal M and the immersion-type burner heater 1 that is installed so as to penetrate the furnace wall 11*a* of the holding tank 11.

On the inner peripheral surface of the heater protection tube 2 at a position that is closer to its tip end side than to the part penetrating the furnace wall 11*a* (the part embedded into the furnace wall 11*a*) is provided a helically extending projecting part 2*a*.

The helical projecting part 2*a* is formed between the portions of the helical groove that is formed on the inner peripheral surface of the heater protection tube 2. This helical projecting part 2*a* is formed up to the tip end of the heater protection tube 2 coaxially therewith.

The heater protection tube 2 is made of, for example, fine ceramics, silicon carbide based refractory, or the like. To this heater protection tube 2 is attached a mounting cylindrical member 5 on the base end side thereof that is fixed to the furnace wall 11*a* through the mounting cylindrical member 5. Note that the mounting cylindrical member 5 may be integrated into the heater protection tube.

The inner cylindrical member 3 is made of heat-resistant metal, ceramics, or the like.

The gas burner part 4 includes a gas supply line 7 for combustion gas that has a jet nozzle 6 at the tip end thereof and an air supply line 8 for supplying air to a combustion flow passage S.

The base end of the gas supply line 7 is connected to a combustion gas pipe (not shown) for supplying combustion gas.

The jet nozzle 6 is arranged so as to project more medially with respect to the furnace wall 11*a* (i.e., towards the tip end side of the heater) into the combustion flow passage S that is a part immersed in the molten metal M in order to leave the flame far away from the furnace wall 11*a* as much as possible.

Figure 3:
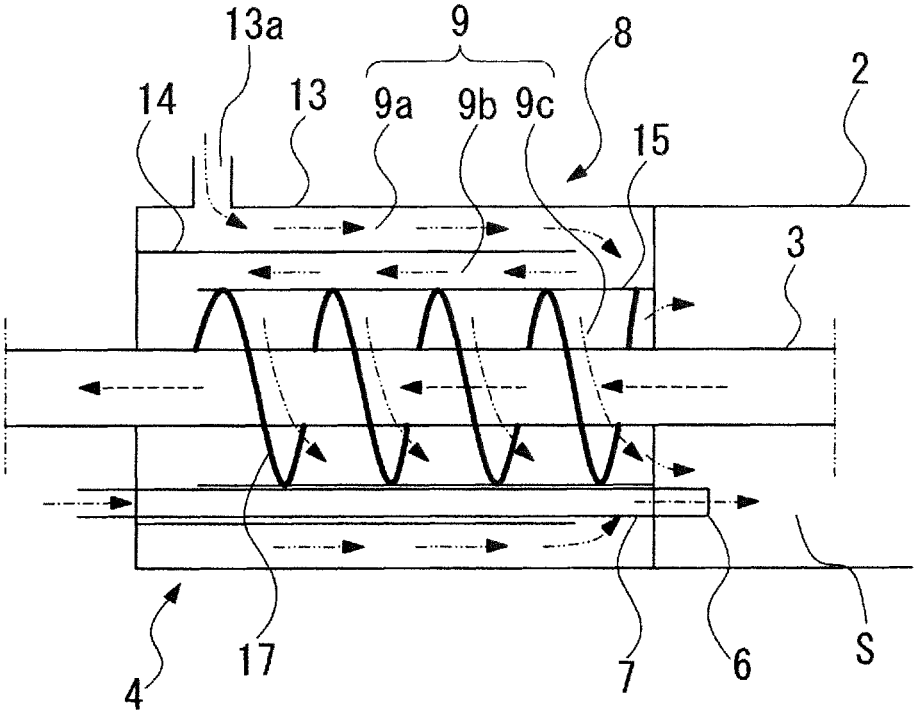
FIG. 3 is a cross-sectional view showing an essential part of the immersion-type burner heater that is penetrating the furnace wall in the first embodiment.

As shown in FIG. 3, the air supply line 8 is attached to the inside of the base end of the heater protection tube 2 and on the outer peripheral surface of the inner cylindrical member 3, and includes an air flow passage 9 for supplying air into the combustion flow passage S at the part penetrating the furnace wall 11*a*.

This air supply line 8 has a triple cylindrical structure, that is, it includes an outer cylindrical part 13 having an air hole 13*a* to which an air pipe 12 is connected on the base end side thereof; a middle cylindrical part 14 that is arranged inside the outer cylindrical part 13 and provided so as to define a first flow passage 9*a* between the outer cylindrical part 13 and itself; and an inner cylindrical part 15 that is arranged inside the middle cylindrical part 14 and provided so as to define a second flow passage 9*b* between the middle cylindrical part 14 and itself and also define a third flow passage 9*c* between the inner cylindrical member 3 and itself. Specifically, the air flow passage 9 is composed of three layers of the first flow passage 9*a*, the second flow passage 9*b*, and the third flow passage 9*c*.

The tip end of the middle cylindrical part 14 is arranged at a position closer to the base end side thereof compared with the tip ends of the outer cylindrical part 13 and the inner cylindrical part 15, and the base end of the inner cylindrical part 15 is arranged at a position closer to the tip end side thereof compared with the base end of the middle cylindrical part 14.

In addition, the tip end of the air supply line 8 is closed except the tip-end opening of the inner cylindrical part 15 (the tip-end opening of the third flow passage 9*c*) and the base end thereof is closed by a flange member 16.

Therefore, the first flow passage 9*a* is in communication with the tip end side of the second flow passage 9*b* on the tip end side thereof. In addition, the second flow passage 9*b* is in communication with the third flow passage 9*c* on the flange member 16 side, and the tip end of the third flow passage 9*c* is open and is in communication with the combustion flow passage S. Specifically, the air that is supplied through an air hole 13*a* to the air supply line 8 firstly flows through the first flow passage 9*a* towards its tip end side, turns around at its tip end side, and then flows through the second flow passage 9*b* towards the flange member 16 side. Furthermore, the air flowing through the second flow passage 9*b* turns around at the flange member 16 side, flows through the third flow passage 9*c* towards its tip end side so as to be supplied through the tip-end opening into the combustion flow passage S.

On the other hand, the gas supply line 7 is penetrating the flange member 16 and is installed so as to be inserted into the second flow passage 9*b* with the jet nozzle 6 projecting into the combustion flow passage S. From the jet nozzle 6, combustion gas is supplied into the combustion flow passage S, where this combustion gas is mixed with the air that is supplied into the combustion flow passage S so as to be burnt.

Note that the first flow passage 9*a* can be formed into a flow passage having a thin layer by configuring the space between the outer cylindrical part 13 and the middle cylindrical part 14 to be narrow, thereby increasing the flow rate of air. As a result, the heat exchange can be performed efficiently.

In the third flow passage 9*c* of the air flow passage 9, a heat exchange fin 17 that is fixed to the inner cylindrical member 3 is provided. This heat exchange fin 17 is helically attached to the outer peripheral surface of the inner cylindrical member 3. Specifically, the air flowing through the third flow passage 9*c* is helically flown by the heat exchange fin 17 and is then supplied into the combustion flow passage S after being warmed by the heat exchange with the inner cylindrical member 3. Note that the heat exchange fin 17 may be fixed to the air supply line 8.

In addition, although the temperature at the time when the combustion gas is burnt is about 1100° C., the energy required for increasing the temperature to the above described combustion temperature can be reduced because the supplied air is warmed as described above.

In FIG. 3, the arrow indicated by the chain double-dashed line depicts the air flow, the arrow indicated by the chain line depicts the combustion gas flow, and the arrow indicated by the dashed line depicts the exhaust gas flow.

As described above, in the immersion-type burner heater 1 of the present embodiment, since the helically extending projecting part 2*a* is provided on the inner peripheral surface of the heater protection tube 2 at a position that is closer to its tip end side than to the part penetrating the furnace wall 11*a*, the combustion gas helically advances in the combustion flow passage S between the inner cylindrical member 3 and the heater protection tube 2 by being guided by the projecting part 2*a*. Due to this configuration, the flow rate of the combustion gas is increased compared with the case without the helical projecting part 2*a*, and therefore the heat transfer coefficient to the heater protection tube 2 by the convection flow is increased.

In addition, the helical advancement of the combustion gas causes a turbulent flow to occur, thereby making it easier to mix the combustion gas with air. As a result, the combustion efficiency can be improved and the amount of the combustion gas that is exhausted from the inner cylindrical member 3 without having been burnt out can be reduced. Furthermore, the increase of the heat transfer coefficient to the heater protection tube 2 can cause the heat exchange to be more actively performed between the molten metal M and the heater 1, thereby lowering the temperature of the exhaust gas. In addition, the projecting part 2*a* can increase the surface area of the heater protection tube 2, thereby further improving the heat exchanging property.

In addition, since the projecting part 2*a* is provided between the portions of the helical groove that is formed on the inner peripheral surface of the heater protection tube 2, the projecting part 2*a* can be readily formed by groove machining or the like on the inner peripheral surface of the heater protection tube 2, and the flow rate or the like of the combustion gas can also be readily set depending on the groove width or the like.

In addition, since the heat exchange fin 17 is provided in the air flow passage 9, the heat exchange is performed between the air that is supplied into the air flow passage 9 and the heat exchange fin 17 that is fixed to the inner cylindrical member 3 or the air supply line 8.

Figure 4:
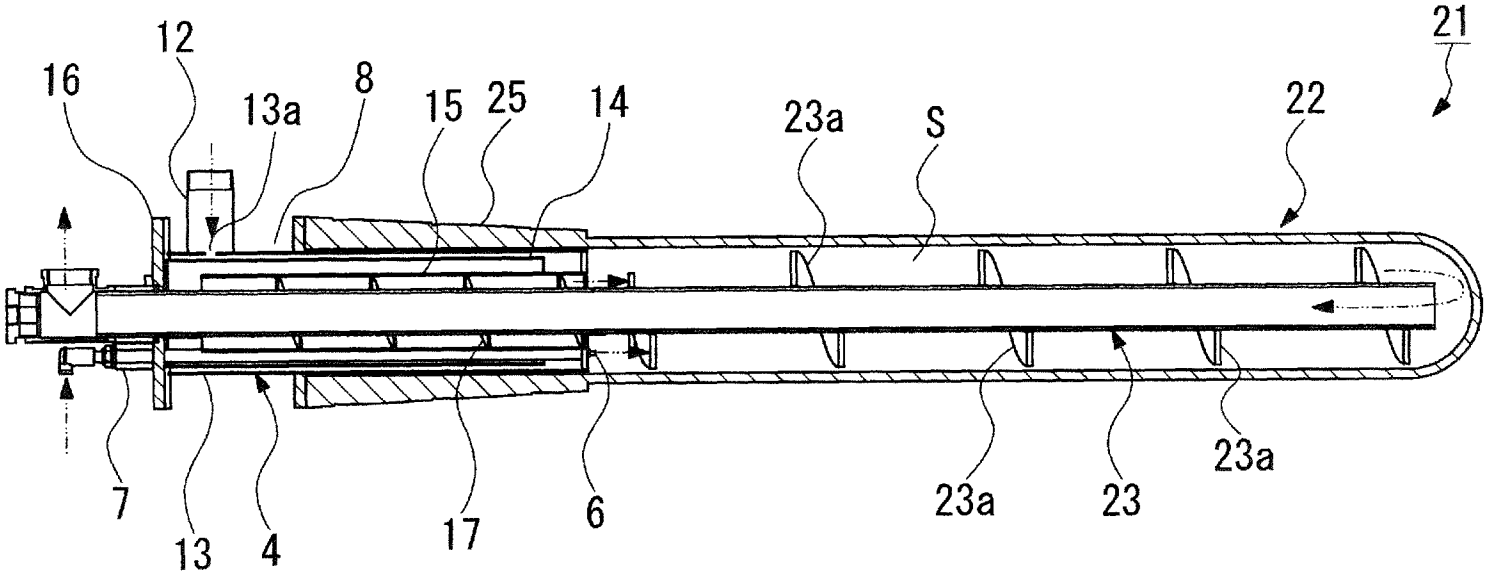
FIG. 4 is a cross-sectional view showing an immersion-type burner heater in an immersion-type burner heater and a molten-metal holding furnace according to a second embodiment of the present invention.
Figure 5:
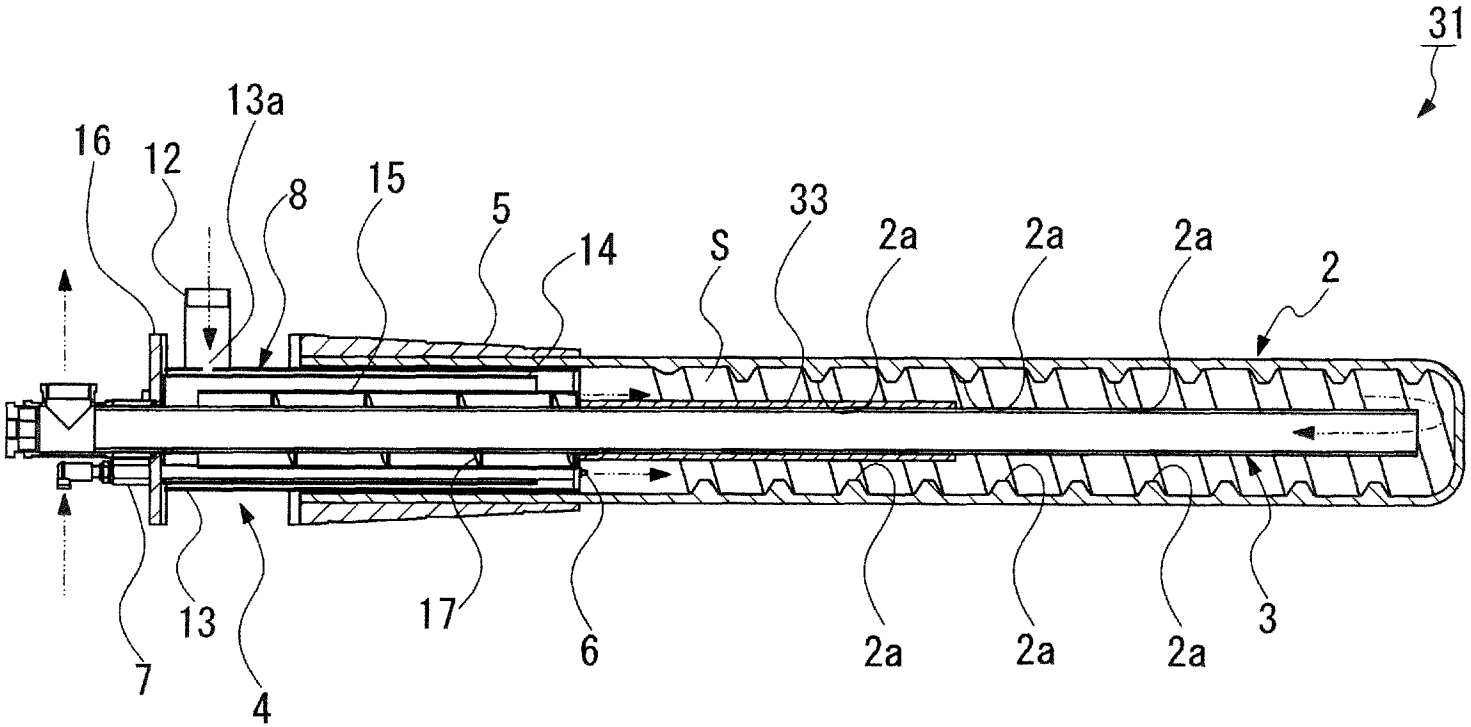
FIG. 5 is a cross-sectional view showing an immersion-type burner heater in an immersion-type burner heater and a molten-metal holding furnace according to a third embodiment of the present invention.
Figure 6:
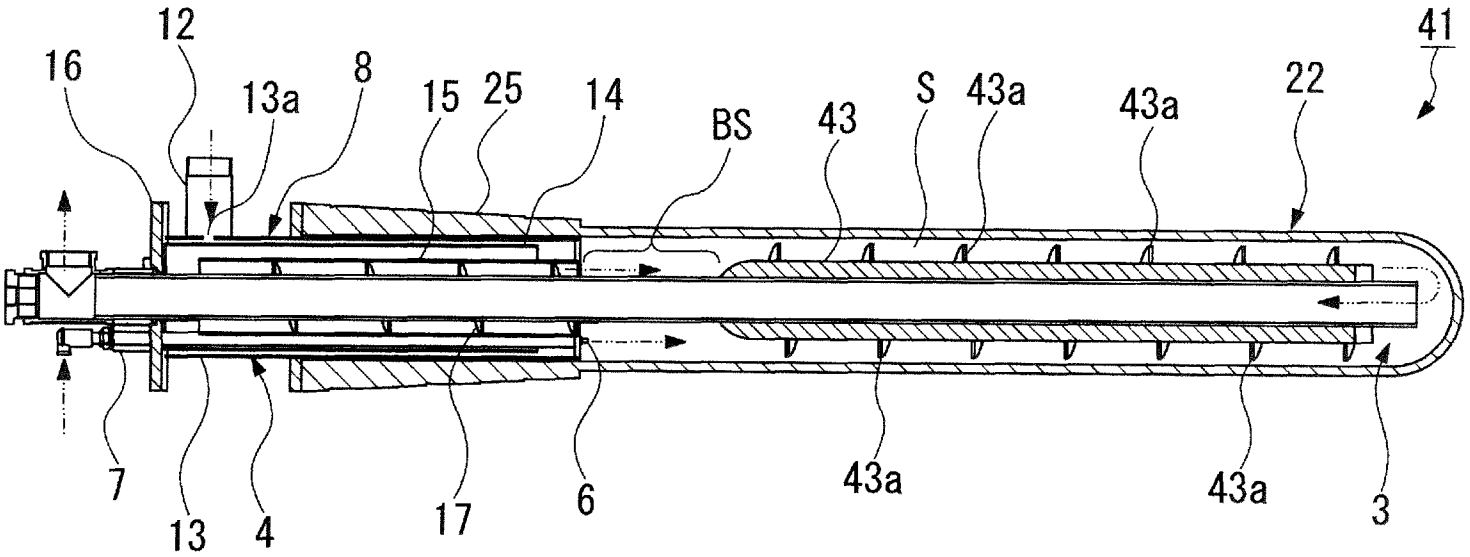
FIG. 6 is a cross-sectional view showing an immersion-type burner heater in an immersion-type burner heater and a molten-metal holding furnace according to a fourth embodiment of the present invention.

Next, immersion-type burner heaters and molten-metal holding furnaces according to second to fourth embodiments of the present invention will be described below with reference to FIGS. 4 to 6. Note that, in the following description of each embodiment, the same components as those in the first embodiment described above are denoted by the same reference numerals, and thus the description thereof is omitted.

The second embodiment is different from the first embodiment in the following points. In the first embodiment, the projecting part 2*a* is provided between the portions of the helical groove that is formed on the inner peripheral surface of the heater protection tube 2, whereas in an immersion-type burner heater 21 and a molten-metal holding furnace according to the second embodiment, as shown in FIG. 4, a projecting part 23*a* is a helical fin that is provided on the outer peripheral surface of an inner cylindrical member 23.

Specifically, in the second embodiment, the helical fin, which constitutes the helical projecting part 23*a* on the outer peripheral surface of the inner cylindrical member 23, defines the helical combustion flow passage S in the gap between the heater protection tube 22 and the inner cylindrical member 23.

The projecting part 23*a* of the helical fin is removably attached to the outer peripheral surface of the inner cylindrical member 23.

Note that, in the heater protection tube 22 according to the second embodiment, the projecting part is not formed by the helical groove on the inner peripheral surface thereof. In addition, the heater protection tube 22 is formed integrally with the mounting cylindrical member so as to have a mounting cylindrical part 25 at the base end thereof. Note that this mounting cylindrical part 25 may be fabricated as a separate mounting cylindrical member from the heater protection tube and then attached thereto as in the first embodiment.

As described above, in the immersion-type burner heater 21 and the molten-metal holding furnace according to the second embodiment, since the projecting part 23*a* is a helical fin that is provided on the outer peripheral surface of the inner cylindrical member 23, the flow rate or the like of the combustion gas can be readily set depending on the shape of the helical fin or the like.

Next, the difference of a third embodiment from the first embodiment will be described below. In the inner cylindrical member 3 according to the first embodiment, the outer peripheral part is exposed in the heater protection tube 2, whereas in an immersion-type burner heater 31 and a molten-metal holding furnace according to the third embodiment, as shown in FIG. 5, a heat insulating member 33 made of a heat insulating material having a lower heat conductivity than that of the heater protection tube 2 is provided on the outer peripheral part of the base end side of the inner cylindrical member 3.

The heat insulating member 33 is formed so as to have a cylindrical shape and is then attached so as to cover the outer peripheral part of the base end of the inner cylindrical member 3. For the heat insulating material of this heat insulating member 33, a heat insulating material of alumina-based ceramics or the like having a lower heat conductivity than that of the heater protection tube 2 may be employed, for example.

As described above, in the immersion-type burner heater 31 and the molten-metal holding furnace according to the third embodiment, since the heat insulating member 33 made of a heat insulating material having a lower heat conductivity than that of the heater protection tube 2 is provided on the outer peripheral part of the base end side of the inner cylindrical member 3, the inner cylindrical member 3 can be prevented from being overheated and heat can be efficiently transferred to the heater protection tube 2.

In addition, since the tip end of the inner cylindrical member 3 is not in direct contact with the flame of the burner, the temperature thereof becomes lower than that of the base end thereof. Therefore, the inner cylindrical member 3 can be prevented from being overheated by dissipating heat from the inner cylindrical member 3 without using the heat insulating member 33.

Next, the difference of a fourth embodiment from the third embodiment will be described below. In the third embodiment, the heat insulating member 33 is provided on the outer peripheral part of the base end side of the inner cylindrical member 3, whereas in an immersion-type burner heater 41 and a molten-metal holding furnace according to the fourth embodiment, as shown in FIG. 6, a heat insulating member 43 is provided on the inner cylindrical member 3 over a range from its base end side to a vicinity of its tip end.

In addition, the fourth embodiment is different from the third embodiment in that a projecting part 43*a* is a helical fin as in the second embodiment and the projecting part 43*a* is provided on the outer peripheral surface of the heat insulating member 43.

As described above, in the immersion-type burner heater 41 and the molten-metal holding furnace according to the fourth embodiment, since the heat insulating member 43 made of a heat insulating material having a lower heat conductivity than that of the heater protection tube 22 is provided on the inner cylindrical member 3 over a range from its base end side to a vicinity of its tip end, the thermal energy generated from the combustion gas can be repelled by the heat insulating member 43 that is provided over a broad range of the outer peripheral part of the inner cylindrical member 3 and heads toward the heater protection tube 22. As a result, the heat transfer coefficient to the heater protection tube 22 can be increased in proportion to the installed range of the heat insulating member 43.

Note that the heat insulating member 43 may be installed on the inner cylindrical member 3 over a range from any position that is slightly spaced apart from its base end up to a vicinity of its tip end as long as it is installed on the base end side of the inner cylindrical member 3. Specifically, since the outer peripheral part in the vicinity of the base end of the inner cylindrical member 3 serves as a combustion space BS for combustion gas, the heat insulating member 43 may be provided on the inner cylindrical member 3 over a range from the middle of its base end side toward its tip end so as to avoid this combustion space BS. Providing the combustion space BS sufficiently can allow the combustion efficiency of the flame to be improved and the amount of an unburned gas to be reduced.

In addition, among the rolls of the helical fin of the projecting part 43*a* that is in direct contact with the flame of the combustion gas near the combustion space BS, at least three rolls of the helical fin from the combustion space BS side may be made of a different material.

The technical scope of the present invention is not limited to the aforementioned embodiments, but the present invention may be modified in various ways without departing from the scope or spirit of the present invention.

For example, in the first embodiment described above, although the helical projecting part is formed on the inner peripheral surface of the heater protection tube, it may be formed on the outer peripheral surface of the inner cylindrical member. In addition, the helical projecting part may be formed on both of the inner peripheral surface of the heater protection tube and the outer peripheral surface of the inner cylindrical member. In this case, the helical projecting parts are preferably configured to extend at the same interval in the same direction on both surfaces.

In addition, in the second embodiment described above, although the projecting part of the helical fin is attached to the outer peripheral surface of the inner cylindrical member, it may be attached to the inner peripheral surface of the heater protection tube. In addition, the projecting part having a shape other than the helical shape may be formed on the inner peripheral surface of the heater protection tube so as to increase the surface area of the heater protection tube.

Furthermore, in each embodiment described above, although the heater protection tube is installed so as to penetrate the furnace wall of the holding tank of the molten-metal holding furnace, that is, so as to be immersed into the molten metal from the lateral side, there may be an upper lid provided for closing the upper opening of the holding tank of the molten-metal holding furnace and then the heater protection tube may be installed so as to penetrate this upper lid. In this case, the immersion-type burner heater is installed so as to penetrate the upper lid of the holding tank with the heater protection tube being inserted through the upper lid so as to be longitudinally extended and immersed into the molten metal.

REFERENCE NUMERALS

1, 21, 31, 41: immersion-type burner heater, 2, 22: heater protection tube, 2*a*, 23*a*, 43*a*: projecting part, 3, 23: inner cylindrical member, 4: gas burner part, 9: air flow passage, 10: molten-metal holding furnace, 11: holding tank, 11*a*: furnace wall, 17: heat exchange fin, 33, 43: heat insulating member, M: molten metal, S: combustion flow passage

What is claimed is:

1. An immersion-type burner heater, comprising:

a heater protection tube installed so as to penetrate a furnace wall or an upper lid of a molten-metal holding furnace with a tip end thereof being closed;

an inner cylindrical member arranged inside the heater protection tube so as to define a combustion flow passage between the heater protection tube and itself with the tip end side thereof being open and the inside thereof serving as an exhaust gas flow passage;

a gas burner part supplying fuel gas and air to the combustion flow passage; and a helically extending projecting part provided on an outer peripheral surface of the inner cylindrical member at a position that is closer to the tip end side of the inner cylindrical member than to a part penetrating the furnace wall or the upper lid; and a heat insulating member made of a heat insulating material having a lower heat conductivity than the heater protection tube and provided on a part of the outer peripheral surface of the inner cylindrical member where the projecting part is provided.

2. The immersion-type burner heater according to claim 1, wherein the projecting part is provided on an outer peripheral surface of the heat insulating member.

3. The immersion-type burner heater according to claim 1, wherein the projecting part is a helical fin that is provided on the outer peripheral surface of the inner cylindrical member.

4. The immersion-type burner heater according to claim 1, further comprising:

an air flow passage supplying air into the combustion flow passage at the part penetrating the furnace wall or the upper lid; and a heat exchange fin that is fixed on the inner cylindrical member or the heater protection tube, the heat exchange fin being provided in the air flow passage.

5. The immersion-type burner heater according to claim 1, wherein the heat insulating member is provided on an outer peripheral part of a base end side of the inner cylindrical member.

6. The immersion-type burner heater according to claim 1, wherein the heat insulating member is provided on the inner cylindrical member over a range from its base end side to a vicinity of its tip end.

7. A molten-metal holding furnace, comprising:

a holding tank holding molten metal; and an immersion-type burner heater according to claim 1 that is installed so as to penetrate a furnace wall or an upper lid of the holding tank.

* * * * *